US009642407B2

(12) United States Patent
Fildan et al.

(10) Patent No.: US 9,642,407 B2
(45) Date of Patent: May 9, 2017

(54) CLOSURE FOR FULL FIGURE BRASSIERES

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 329 days.

(21) Appl. No.: 14/549,702

(22) Filed: Nov. 21, 2014

(65) Prior Publication Data

US 2016/0000164 A1 Jan. 7, 2016

Related U.S. Application Data

(60) Provisional application No. 62/020,435, filed on Jul. 3, 2014.

(51) Int. Cl.
*A41F 1/00* (2006.01)

(52) U.S. Cl.
CPC ..... *A41F 1/006* (2013.01)

(58) Field of Classification Search
CPC . A41F 1/006; A41F 1/002; A41C 3/00; A44B 13/0058; A44B 13/0041; A44B 13/0047
USPC ..... 2/226, 338; 450/92, 63, 14, 9, 13, 17, 450/18, 26, 28, 71–73, 82, 58; 24/578.1, 24/578.14, 588.12, 465, 444, 591.1, 448, 24/466, 666.667, 689.1, 695
See application file for complete search history.

(56) References Cited

U.S. PATENT DOCUMENTS

| | | | | |
|---|---|---|---|---|
| 4,183,121 | A * | 1/1980 | Cousins | A44B 13/0023 24/588.1 |
| 4,606,079 | A * | 8/1986 | DeWoskin | A41F 1/006 2/338 |
| 4,633,565 | A * | 1/1987 | DeWoskin | A41F 1/006 156/66 |
| 7,722,433 | B2 * | 5/2010 | Utaka | A41F 1/006 450/63 |
| 8,745,829 | B2 * | 6/2014 | Wanzenboeck | A41F 1/006 2/338 |
| 2006/0094336 | A1 * | 5/2006 | Fildan | A41C 3/00 450/92 |
| 2010/0101058 | A1 * | 4/2010 | Fildan | A41F 1/006 24/578.14 |
| 2012/0102686 | A1 * | 5/2012 | Wanzenboeck | A41F 1/006 24/591.1 |

(Continued)

*Primary Examiner* — Gloria Hale
(74) *Attorney, Agent, or Firm* — Kintner IP, LLC; Mary Frances Ludwig

(57) ABSTRACT

A brassiere closure for full figured brassieres or orthopedic use includes an easily operable engagement of a single large loop and hook. The loop is positionable into an open position in which the hook may readily engage the loop. When pressure is applied to the loop, the loop assumes a closed position, thereby connecting the two wings of the brassiere. In an embodiment, the loop has a D-shaped ring which is hinged to a base, and the hook is ovate and self-centering. In another embodiment, an integral double spring serves to bias the loop in an open position. In another embodiment, secondary magnetic fasteners are used for additional strength and to assist in aligning the loop and the hook. The size and novel features of the closure make it easily operable, even when located behind the wearer's back.

18 Claims, 4 Drawing Sheets

(56) References Cited

U.S. PATENT DOCUMENTS

2016/0000064 A1* 1/2016 Liu ..... A01N 1/0215
435/2

* cited by examiner

CLOSURE FOR FULL FIGURE BRASSIERES

CROSS REFERENCE TO RELATED APPLICATION

This application claims the filing benefit under 35 U.S.C. §119(e) of U.S. Provisional Application No. 62/020,435, filed 3 Jul. 2014, which is hereby incorporated by reference.

TECHNICAL FIELD

The present invention pertains generally to garment closures, and more particularly to an easily operable brassiere closure for full figured or disabled individuals.

BACKGROUND OF THE INVENTION

Common brassiere closures include multiple small eyes which engage an equal number of small hooks, typically behind the back of the wearer. Such closures are difficult to operate for those who are full figured or have a physical disability such as arthritis, and may be impossible to operate for some, such as those who have lost the use of an arm or hand.

While some prior art closures, such as front closures, are designed for simpler operation, their positioning in between the brassiere cups interferes with the support elements required for a full figured wearer.

The present closure overcomes these shortcomings by being operable with one simple motion, while also providing adequate support for a full figure brassiere.

BRIEF SUMMARY OF THE INVENTION

The present invention is directed to a brassiere closure for a full figure or for orthopedic use. The closure has two members, each attached to one wing of the brassiere. The first closure member includes a single large loop or hook, in contrast to the multiple loops or hooks of common closures. The second closure member includes several of the other of loops and hooks, to allow for adjustment of the brassiere size. A single loop and hook are engaged to connect the brassiere wings.

In accordance with an embodiment of the closure, the loop has an open position and a closed position. In the open position, the hook may readily engage the loop. When the hook and the loop are engaged, and pressure is applied to the loop, the loop assumes the closed position and the brassiere wings are connected.

In accordance with another embodiment, the loop has a ring which is hingably mounted to a base and positioned at an angle with respect to the base when the loop is in the open position.

In accordance with another embodiment, when the loop is in the closed position, the ring is positioned within a depression of the base.

In accordance with another embodiment, the ring is D-shaped and the hook is ovate.

In accordance with another embodiment, a single loop is attached to the first closure member and a plurality of hooks are attached to the second closure member and arranged in a longitudinally spaced row.

In accordance with another embodiment, the loop has a double spring which resists motion of the loop from the open position into the closed position. In another embodiment, the double spring biases the loop in the open position.

In accordance with another embodiment, the length of the hook is between about 15 mm and about 50 mm.

In accordance with another embodiment, the loop has a catch for catching the hook and providing resistance to disengaging the hook from the loop.

In accordance with another embodiment, the hook has multiple pins which project through a closure member and subsequently through multiple holes in a hook backing. The closure member is sandwiched between the hook and hook backing, and the hook backing provides support to the hook.

In accordance with another embodiment, the closure includes secondary fasteners for additional support. In an embodiment, the secondary fasteners are magnetic and assist in aligning the hook with the loop.

In accordance with another embodiment, the hook and the loop are ultrasonically welded to a fabric layer of the closure members.

Other embodiments, in addition to the embodiments enumerated above, will become apparent from the following detailed description, taken in conjunction with the accompanying drawings, which illustrate, by way of example, the principles of the closure and method of use.

LIST OF DRAWING REFERENCE NUMERALS

Figure 1A:
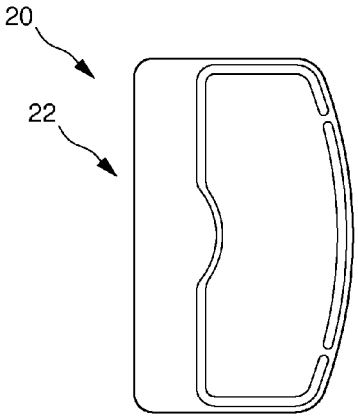
FIGS. 1A and 1B are front elevation views of a first and a second closure member, respectively, of a closure for connecting two wings of a brassiere.
Figure 1B:
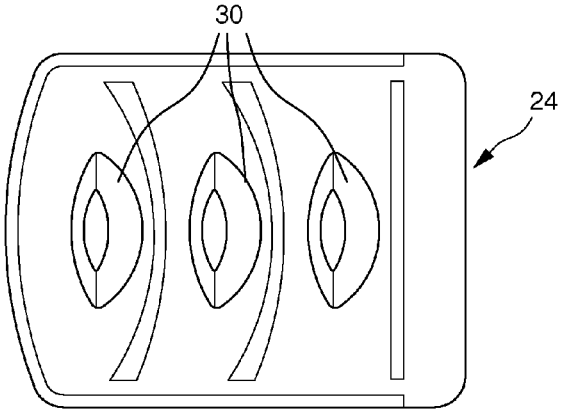

| | |
|---|---|
| 20 | closure |
| 22 | first closure member |
| 24 | second closure member |
| 30 | hook |
| 32 | pins |

-continued

| LIST OF DRAWING REFERENCE NUMERALS | | | |
|---|---|---|---|
| 38 | roof | | |
| 34 | hook backing | | |
| 35 | central region | | |
| 36 | holes | | |
| 37 | stays | | |
| 39 | ends | | |
| 40 | loop | | |
| 42 | open position | 44 | closed position |
| 46 | ring | 48 | base |
| 50 | depression | 52 | catch |
| 54 | hinge | 56 | double spring |
| 60 | secondary fastener | | |
| 62 | male element | 64 | female element |
| 66 | magnet | | |
| 70 | fabric | | |
| 80 | welds | | |
| 500 | wings | | |

DETAILED DESCRIPTION OF THE INVENTION

Referring initially to FIGS. 1A, 1B, 2A, and 2B, there are illustrated, respectively, front elevation views of a first closure member 22 and a second closure member 24 of a closure for connecting two wings of a brassiere, and rear elevation views of the same. While "closure" is described herein as a closure for a brassiere, its use is not limited to brassieres, as it would function on a variety of garments such as lingerie, support garments, and others. "Front" as used herein refers to the face oriented toward the wearer, while "rear" refers to the face oriented away from the wearer. The closure is generally designated as 20 and the wings of the brassiere as 500. "Wings" of a brassiere refer to two fabric sections, each connected to a cup of the brassiere at one end, which wrap around the back of the wearer and are fastenable to each other at the other ends.

Figure 3:
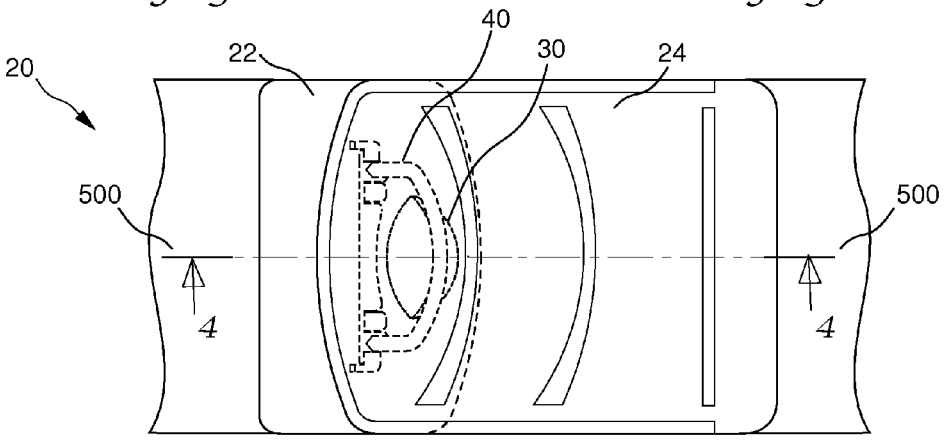
FIG. 3 is a rear elevation view of the first closure member engaged with the second closure member.

Closure 20 has first closure member 22 which attaches to one of two brassiere wings 500, and second closure member 24 which attaches to the other wing 500 (attachment to wings 500 shown in FIG. 3). Closure 20 further includes a loop 40 and a hook 30 engagable with loop 40. One of loop 40 and hook 30 is attached to first closure member 22. "One of" here refers to one of the set consisting of hook and loop (i.e. either a hook or a loop), and not to one of each member of the set (i.e. not meaning a hook and a loop). A plurality of the other of hook 30 and loop 40 are attached to second closure member 24 and arranged in a longitudinally spaced row. A single loop 40 is engaged with a single hook 30 to complete the connection of brassiere wings 500. Having a single fastened loop and hook is a distinguishing feature, as brassiere closures commonly fasten by means of multiple (typically three or four) loops or hooks transversely spaced in a column. The row of hooks 30 or loops 40 on second closure member 24 allows the wearer to adjust the fit of the brassiere by engaging with a loop or hook farther from the wing end of second closure member 24 (larger size) or closer to the wing end (smaller size).

Loop 40 has an open position 42 (see FIG. 5A) in which hook 30 may readily engage loop 40. When hook 30 engages loop 40 and pressure is applied to loop 40, loop 40 assumes a closed position 44, and the two wings of the brassiere are thereby connected. In the embodiments shown throughout, a single loop 40 is attached to first closure member 22 and a plurality of hooks 30 are attached to second closure member 24. However, the closure would function in the alternate arrangement, where a single hook 30 is attached to first closure member 22 and a plurality of loops 40 are attached to second closure member 24. The shown arrangement is preferred since loop 40 is a larger and more complex part than hook 30. Therefore having only one loop 40 reduces the overall size, complexity, and cost of closure 20. Also in the shown embodiment, loop 40 faces away from the wearer. The closure would function in an arrangement where loop 40 faces the back of the wearer and hook 30 faces away from the wearer. However, the shown arrangement is preferred as it is less likely for loop 40 accidentally assume the closed position while engagement with hook 30 is being attempted. In addition, the shown arrangement is more comfortable for the wearer as the large loop element faces away from the skin.

FIG. 3 is a rear elevation view of first closure member 22 connected to second closure member 24. Loop 40 and an engaged hook 30 are shown in hidden lines. First and second closure members 22 and 24 of closure 20 each attach to a wing 500 at one end, and connect to each other at the other ends, thereby fastening the brassiere.

Figure 4:
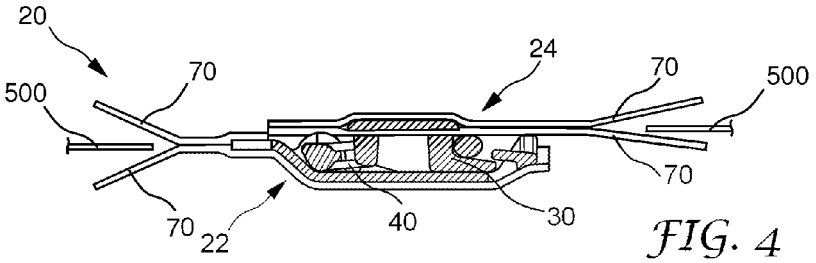
FIG. 4 is an enlarged cross-sectional view along the line 4-4 of FIG. 3.
Figure 12A:
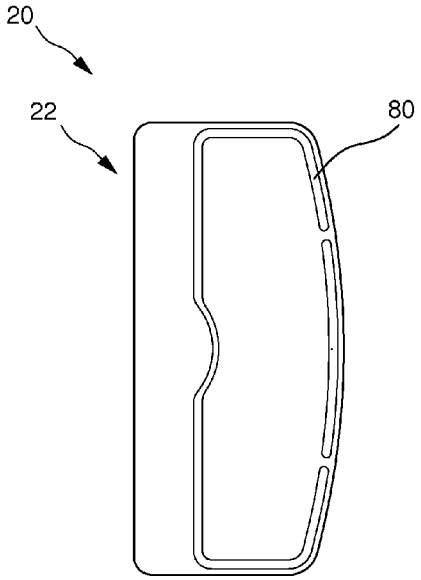
FIGS. 12A and 12B are front elevation views of another embodiment of the first and second closure members, respectively.
Figure 12B:
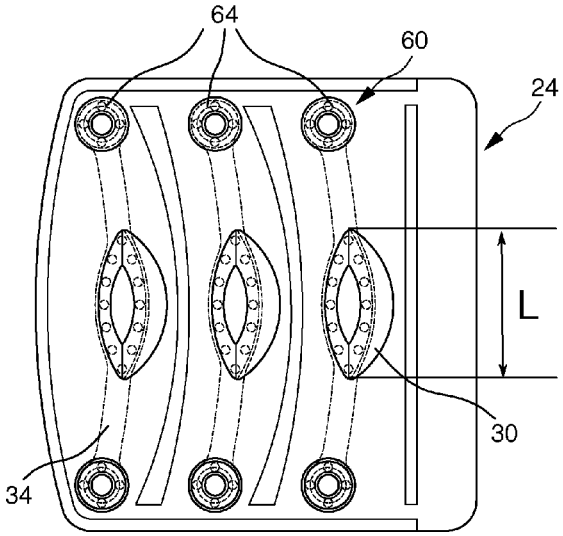
Figure 13A:
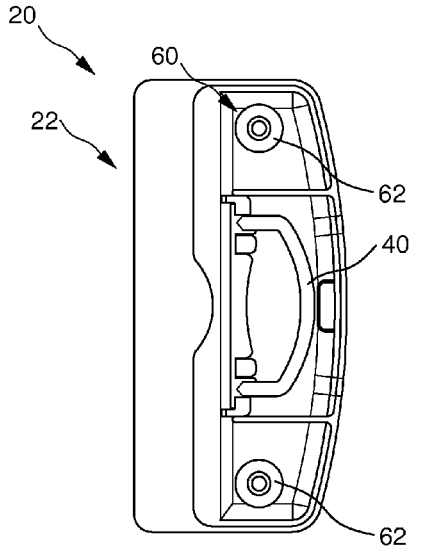
FIGS. 13A and 13B are rear elevation views of another embodiment of the first and second closure members, respectively.
Figure 13B:
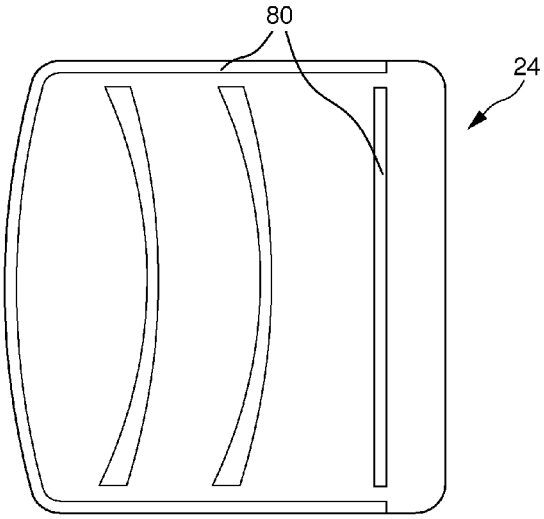

FIG. 4 is an enlarged cross-sectional view of closure 20 along the line 4-4 of FIG. 3, showing hook 30 engaged with loop 40. In the shown embodiment, first closure member 22 and second closure member 24 each include either a hook 30 or loop 40 affixed to two layers of fabric 70. The fabric layers extend away from the hook or loop and wing 500 is attached between them. Hook 30 and loop 40 are preferably fabricated from plastic. The fabric layer of closure members 22 and 24 is preferably a laminated material where the inner lining is a fusible material, such as nylon tricot fabric, and the exterior may be cotton, silk, microfiber nylon, or the like. In an embodiment, loop 40 and hook 30 are welded to fabric layers 70 of closure members 22 and 24 along welds 80 (see FIGS. 12-13). The preferred method of welding is an ultrasonic weld as described in U.S. Pat. No. 8,186,025 to Fildan, et al. Each wing 500 may be attached to one or more of fabric layer 70 by a similar ultrasonic weld or by simply sewing or the like.

Figure 5A:
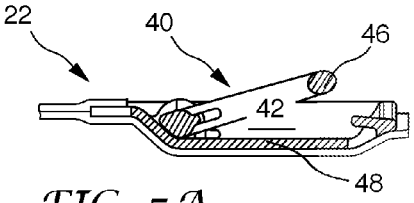
FIGS. 5A and 5B are enlarged cross-sections of a loop in an open position and a closed position, respectively.
Figure 5D:
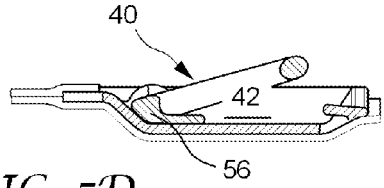
FIG. 5D is an enlarged cross-sectional view along the line 5D-5D of FIG. 2A.
Figure 5B:
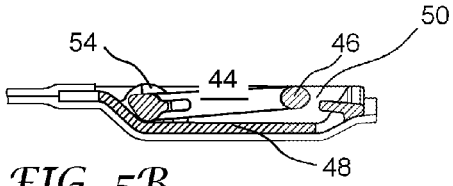

FIGS. 5A and 5B are enlarged cross-sections of first closure member 22 showing loop 40 in open position 42 and closed position 44, respectively. Loop 40 has a ring 46 which is hingably mounted to a base 48 by a hinge 54. When loop 40 is in open position 42, ring 46 is positioned at an angle with respect to base 48. In open position 42, loop 40 is readily engagable with hook 30 (see FIG. 7B). Readily engagable means that the loop is positioned such that no further maneuvering of the loop is required to engage the hook. Loop 40 may be positioned to open position 42 before the wearer puts on the brassiere, further simplifying the fastening of the brassiere wings. In an embodiment, loop 40 is biased in open position 42.

Figure 5C:
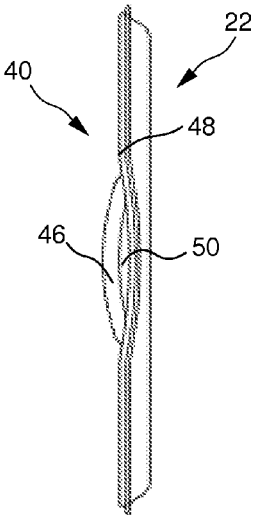
FIG. 5C is a side elevation view of the loop in the closed position.

FIG. 5C is a side elevation view of first closure member 22 showing loop 40 in closed position 44. Base 48 has a depression 50. When loop 40 is in closed position 44, ring 46 is positioned within depression 50 (see also FIG. 5B). Base 48 is curved on the shown side in the area of depression 50. To open loop 40 from closed position 44, the wearer may insert a finger into depression 50 between base 48 and ring 46, and pivot ring 46 open by hinge 54 (see FIGS. 5A & 5B).

Figure 2A:
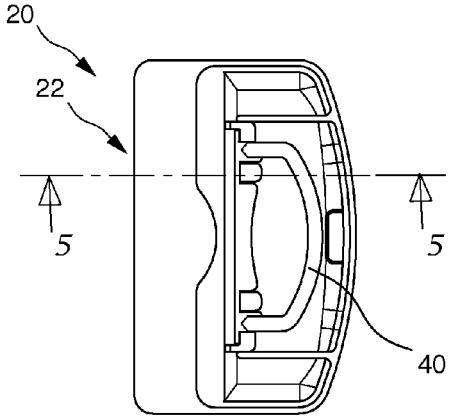
FIGS. 2A and 2B are rear elevation views of the first and second closure members, respectively.
Figure 2B:
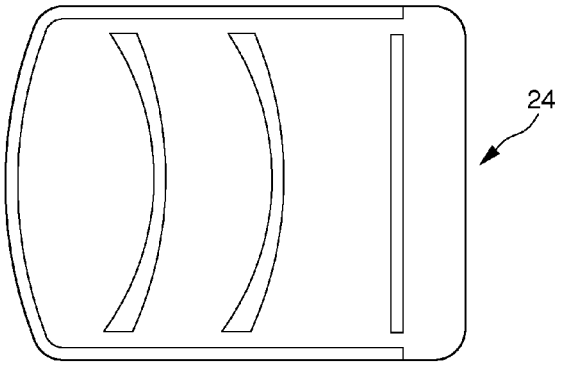

FIG. 5D is an enlarged cross-sectional view along the line 5D-5D of FIG. 2A. In an embodiment, loop 40 has a double spring 56 (one spring is visible in the cross-section of FIG. 5D, while both springs are visible from the elevation of FIG. 2A). When loop 40 is in open position 42, double spring 56 resists motion of loop 40 into the closed position. In another embodiment, double spring 56 biases loop 40 in open position 42. "Bias" herein means that loop 40 defaults to open position 42 when not engaged with a hook.

Figure 6:
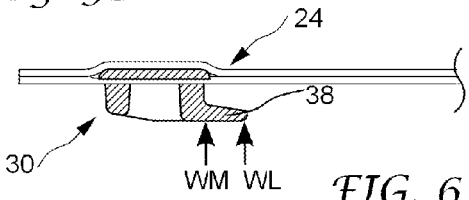
FIG. 6 is an enlarged cross-section of a hook.

FIG. 6 is an enlarged cross-section of second closure member 24 showing one of hooks 30. In an embodiment, ring 46 of loop 40 is D-shaped, and hook 30 is ovate (see FIGS. 1A, 2A, & 5A-5B). These shapes have the beneficial effect that the hook self-centers on the ring. The hook and ring may be otherwise shaped and the closure would still function, for example the ring may be semi-circular and the hook J-shaped. In an embodiment, hook 30 has a roof 38 and the width of roof 38 is tapered from a maximum width WM to a lesser width WL. When hook 30 and loop 40 are engaged, ring 46 is closely coupled with roof 38 at the point of maximum width WM (see FIG. 4). In other words, when the hook and loop are engaged they may only be in close contact in a small area.

Figure 7A:
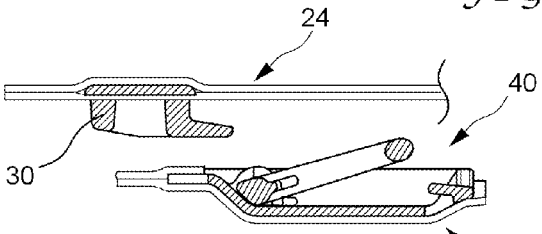
FIGS. 7A-7C are enlarged cross-sections of the hook and the loop in progressive stages of engagement.
Figure 7B:
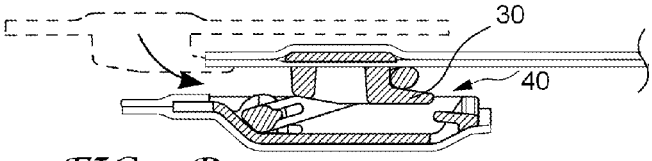
Figure 7C:
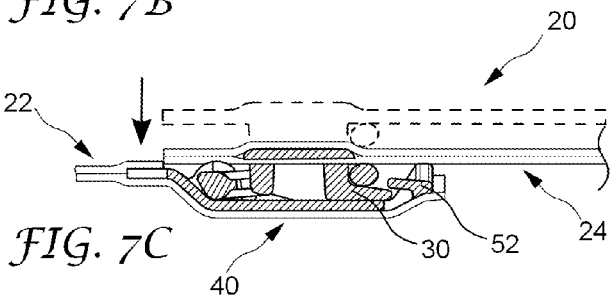

FIGS. 7A-7C are enlarged cross-sections of hook 30 and loop 40 in progressive stages of engagement. In FIG. 7A, loop 40 is in open position 42 (see FIG. 5A). Second closure member 24 is positioned to overlap first closure member 22. In FIG. 7B, hook 30 is engaging with loop 40. With loop 40 in open position 42, engagement of hook 30 with loop 40 is a simple maneuver performed by sliding hook 30 down and into open loop 40. In FIG. 7C, pressure is applied to loop 40 (downward arrow) which assumes closed position 44 (see FIG. 5B). In this manner the first and second closure members 22 and 24 are drawn together and closure 20 is fully closed.

Loop 40 has a catch 52, for catching hook 30 (see FIG. 7C). When closure 20 is closed, catch 52 provides resistance to disengaging hook 30 from loop 40. Catch 52 is recessed below ring 46 in closed position 44, so that it does not interfere with the wearer inserting a finger to pivot ring 46 into open position 42 (see FIGS. 5A-5B). Catch 52 deflects slightly to allow closure to be made as shown in FIG. 7C.

Figure 8:
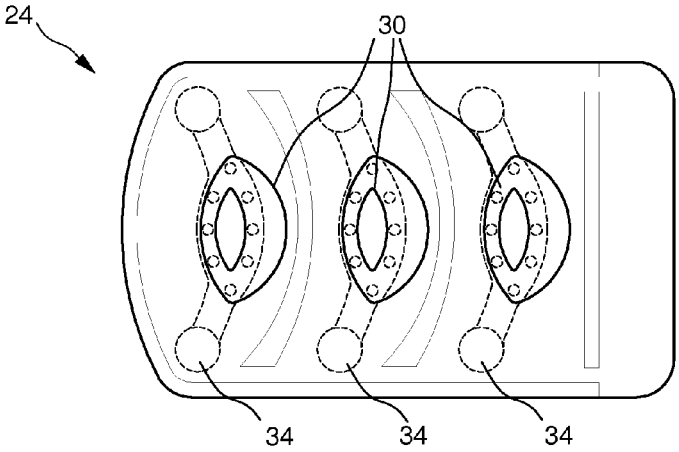
FIG. 8 is a front elevation view of an embodiment of the second closure member.
Figure 10A:
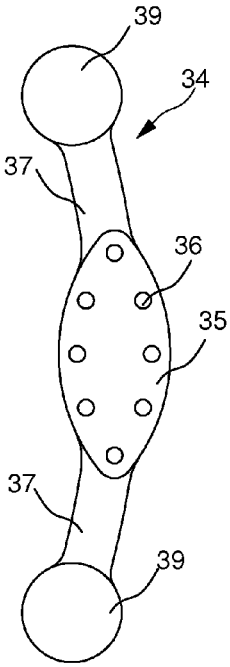
FIGS. 10A and 10B are enlarged front and side elevation views, respectively, of a hook backing.
Figure 10B:
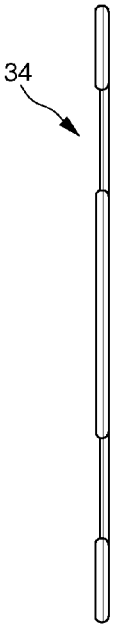
Figure 9A:
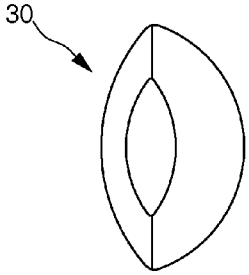
FIGS. 9A and 9B are enlarged front and rear elevation views, respectively, of the hook.
Figure 9B:
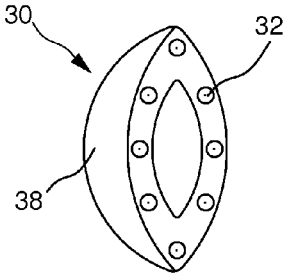

FIG. 8 is a front elevation view of an embodiment including a plurality of hooks 30 attached to second closure member 24. Each hook 30 has a corresponding hook backing 34, shown in hidden lines. FIGS. 9A and 9B are enlarged rear and front elevation views, respectively, of hook 30. Hook 30 has a plurality of pins 32, or spikes, visible in the front view of FIG. 9B. FIGS. 10A and 10B are enlarged front and side elevation views, respectively, of hook backing 34. Hook backing 34 has a plurality of holes 36.

Figure 11A:
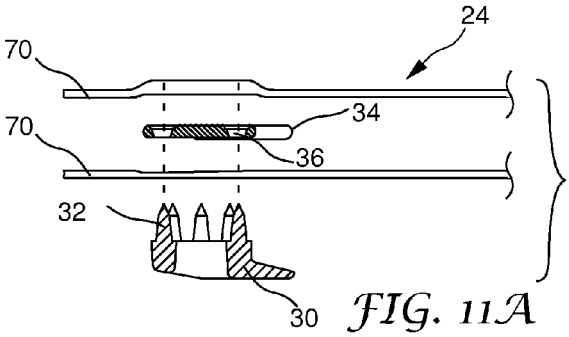
FIGS. 11A and 11B are enlarged exploded and assembled cross-sectional views, respectively, of the second closure member.
Figure 11B:
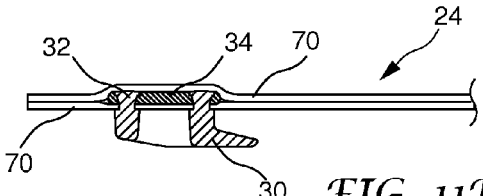

FIGS. 11A and 11B are enlarged exploded and assembled cross-sectional views, respectively, of second closure member 24. In the shown embodiment, second closure member 24 includes two fabric layers 70, hook 30, and hook backing 34 (additional hooks 30 and corresponding additional hook backings 34 are out of view). One fabric layer 70 is sandwiched between hook 30 and hook backing 34. Pins 32 of hook 30 project through fabric layer 70 and through holes 36 of hook backing 34. Pins 30 are preferably made of plastic and, when assembled through holes 36 of hook backing 34 and heated, the tips of pins 30 flatten and expand to join hook 30 to hook backing 34 in the manner of a rivet. The two fabric layers 70 are joined so that hook backing 34 is hidden between fabric layers 70.

Hook backing 34 provides additional support to hook 30, and prevents fabric layer 70 of second closure member 24 from rolling up under stress. As desired for a full figured brassiere, hook backing 34 enables the closure member having hook 30 (either first or second closure member 22 or 24) to hold at least 30 pounds (lbs) of stress. In an embodiment, hook backing 34 has a length at least twice the length L of hook 30 (see FIG. 12B). In another embodiment, hook backing 34 has a central region 35 shaped complementary to the profile of at least a portion of hook 30. In the shown case, central region 35 has a shape complementary to the profile of hook 30 excluding roof portion 38 (see FIG. 9B). The shapes are complementary in that they are similarly, rather than exactly, shaped. Hook backing 34 has elongated stays 37 which extend from central region 35 and terminate in rounded ends 39.

FIGS. 12A, 12B, 13A, and 13B are, respectively, front elevation views of another embodiment of the first and second closure members, and rear elevation views of the same. In the embodiment, closure 20 includes a secondary fastener 60 having a male element 62 and female element 64. Male element 62 is attached to one of first closure member 22 and second closure member 24, and female element 64 is attached to the other closure member. In the shown embodiment, two of male element 62 are present, one adjacent to either end of loop 40. Female elements 64 are adjacent to either end of each hook 30, and fastened to hook backing 34 (shown in hidden lines) in the manner described in the discussion of FIGS. 11A&B. Rounded ends 39 provide a region for fastening secondary fasteners 60 to hook backing 34 (see also FIG. 10A). Secondary fasteners 60 provide additional strength for the closure, which is especially beneficial when a larger sized closure is desired. An alternate arrangement of secondary fasteners 60 includes female elements 64 adjacent to either end of each loop 40 and male elements 62 adjacent to either end of each hook 30.

Secondary fasteners 60 could be any type of fastener well known in the art, such as snaps. In an embodiment, secondary fasteners 60 are magnetic, and male element 62 and female element 64 have magnets aligned to attract each other. This type of fastener also assists in alignment of hook 30 and loop 40. When hook 30 is positioned near loop 40, magnets of male elements 62 attract magnets of female elements 64 and help guide hook 30 toward loop 40. Such a magnetic fastener is described in U.S. Pat. No. 8,505,174 to Fildan, et al In an embodiment, hook 30 has a length (L) of between about 15 mm and about 50 mm (see FIG. 12B). Loop 40 must be large enough for easy positioning into the open and closed positions, and is therefore preferred to be comparable in size to one or more finger widths. The size of hook 30 is preferred to fit with slight play when engaged with loop 40. Prior art closures teach away from such a large hook or loop, as commonly closures are sized to be discreet and therefore small. However, in the present closure, the preferred size is beneficial for ease of operation, especially by disabled individuals.

In terms of use, a method of closing a brassiere includes: (refer to FIGS. 1-13)

(a) providing a brassiere having two wings 500 and a closure 20 including:
  (i) a first closure member 22 attached to one of wings 500;
  (ii) a second closure member 24 attached to the other of wings 500;
  (iii) a loop 40;
  (iv) a hook 30 engagable with loop 40;
  (v) one of loop 40 and hook 30 attached to first closure member 22;
  (vi) a plurality of the other of loop 40 and hook 30 attached to second closure member 24 and arranged in a longitudinally spaced row; and,
  (vii) loop 40 having an open position 42 and a closed position 44;

(b) positioning loop 40 in open position 42 so that hook 30 may readily engage loop 40;

(c) engaging a single hook 30 with a single loop 40; and, (d) applying pressure to loop 40 so that loop 40 assumes closed position 44, thereby connecting two wings 500 of the brassiere.

The method further including:

in (a), loop 40 having a catch 52 for catching hook 30; and, in (d), catch 52 catching hook 30 and providing resistance to disengaging hook 30 from loop 40.

The method further including:

in (a), closure 20 having a secondary fastener 60, having a male element 62 and a female element 64, male element 62 attached to one of first closure member 22 and second closure member 24 and female element 64 attached to the other of first closure member 22 and second closure member 24; and, after (c), connecting male element 62 and female element 64.

The embodiments of the closure and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the closure and method should be construed as limiting the invention to a particular embodiment or combination of embodiments. The scope of the invention is defined by the appended claims.

We claim:

1. A closure for connecting two wings of a brassiere, each wing having an end, the closure comprising:

a first closure member configured for attachment to the end of one of the wings;

a second closure member configured for attachment to the end of the other one of the wings;

a loop;

a hook engagable with said loop;

said loop or said hook attached to said first closure member;

either: (1) a plurality of said hook attached to said second closure member and arranged in a longitudinally spaced row, when said loop is attached to said first closure member, or (2) a plurality of said loop attached to said second closure member and arranged in a longitudinally spaced row, when said hook is attached to said first closure member;

said loop having an open position in which said hook may readily engage said loop, and a closed position; and, when a single said hook engages a single said loop and pressure is applied to said loop, said loop assuming said closed position, thereby connecting the ends of the two wings of the brassiere when said first closure member is attached to the end of one of the wings and said second closure member is attached to the end of the other one of the wings.

2. The closure according to claim 1, further including:

said loop having a ring and a base;

said ring hingably mounted to said base; and, when said loop is in said open position, said ring is positioned at an angle with respect to said base.

3. The closure according to claim 2, further including:

said base of said loop having a depression; and, when said loop is in said closed position, said ring is positioned within said depression.

4. The closure according to claim 2, further including:

said ring of said loop being D-shaped; and, said hook being ovate.

5. The closure according to claim 4, further including:

said hook having a roof;

said roof having a width, said width being tapered from a maximum width to a lesser width; and, when said hook and said loop are engaged, said ring of said loop being closely coupled with said roof at said maximum width.

6. The closure according to claim 1, further including:

a single said loop being attached to said first closure member; and, a plurality of said hook being attached to said second closure member.

7. The closure according to claim 1, further including:

said loop having a double spring; and, when said loop is in said open position, said double spring resisting motion of said loop into said closed position.

8. The closure according to claim 7, further including:

said double spring biasing said loop in said open position.

9. The closure according to claim 1, further including:

said hook having a length of between about 15 mm and about 50 mm.

10. The closure according to claim 1, further including:

said loop having a catch for catching said hook and providing resistance to disengaging said hook from said loop.

11. The closure according to claim 1, further including:

said hook having a plurality of pins;

a hook backing having a plurality of holes;

a fabric layer sandwiched between said hook and said hook backing, said fabric layer configured for attachment to the end of one of the wings; and, said hook attached to said fabric layer by said pins projecting through said fabric layer and through said holes of said hook backing, said hook backing providing support to said hook.

12. The closure according to claim 11, further including:

said hook backing having a central region shaped complementary to the profile of at least a portion of said hook;

said hook backing having elongated stays extending from said central region; and, said elongated stays terminating in rounded ends.

13. The closure according to claim 1, further including:

a secondary fastener, having a male and a female element, said male element attached to one of said first closure member and said second closure member and said female element attached to the other of said first closure member and said second closure member.

14. The closure according to claim 13, further including:

said male and female elements of said secondary fastener having complementary magnets aligned to attract each other so that when said hook is positioned near said loop, said magnets attract and connect to aid in the engagement thereof.

15. The closure according to claim 1, further including:

said first and second closure members each having a fabric layer configured for attachment to the end of one of the wings; and, said hook and said loop being ultrasonically welded to said fabric layer.

16. A method of closing a brassiere, comprising:

(a) providing a brassiere having a closure and two wings, each wing having an end, the closure including:

(i) a first closure member attached to said end of one of said wings;

(ii) a second closure member attached to said end of the other of said wings;

(iii) a loop;

(iv) a hook engagable with said loop;

(v) said loop or said hook attached to said first closure member;

(vi) either: (1) a plurality of said hook attached to said second closure member and arranged in a longitudinally spaced row, when said loop is attached to said first closure member, or (2) a plurality of said loop attached to said second closure member and arranged in a longitudinally spaced row, when said hook is attached to said first closure member; and, (vii) said loop having an open position and a closed position;

(b) positioning said loop in said open position so that said hook may readily engage said loop;

(c) engaging a single said hook with a single said loop; and, (d) applying pressure to said loop so that said loop assumes said closed position, thereby connecting said two wings of said brassiere.

17. The method according to claim 16, further including:

in (a), said loop having a catch for catching said hook; and, in (d), said catch catching said hook and providing resistance to disengaging said hook from said loop.

18. The method according to claim 16, further including:

in (a), said closure having a secondary fastener, having a male and a female element, said male element attached to one of said first closure member and said second closure member and said female element attached to the other of said first closure member and said second closure member; and, after (c), connecting said male element and said female element.

* * * * *